United States Patent [19]

Card et al.

[11] Patent Number: 4,559,885

[45] Date of Patent: Dec. 24, 1985

[54] APPARATUS AND PROCESS FOR PRODUCING A CHAIN STITCHED TUFTED PRODUCT

[76] Inventors: Roy T. Card, 4012 Creekwood Ter., Chattanooga, Tenn. 37421; Joseph L. Card, 1515 Edgewood Cir., Chattanooga, Tenn. 37405

[21] Appl. No.: 663,183

[22] Filed: Oct. 22, 1984

[51] Int. Cl.[4] ..... D05C 15/00

[52] U.S. Cl. ..... 112/266.2

[58] Field of Search ..... 66/79 R, 79 A, 266.2

[56] References Cited

U.S. PATENT DOCUMENTS

| | | | |
|---|---|---|---|
| 3,401,657 | 9/1968 | Watkins | 112/79 R |
| 3,421,929 | 1/1969 | Watkins | 112/79 R |
| 3,780,678 | 12/1973 | Short | 112/79 R |
| 4,285,286 | 8/1981 | Hash | 112/79 R |
| 4,419,944 | 12/1983 | Passons et al. | 112/79 R |

*Primary Examiner*—Ronald Feldbaum

*Attorney, Agent, or Firm*—Newton, Hopkins & Ormsby

[57] ABSTRACT

A conventional tufting machine is provided with a looper control cam which enables it to sew chain stitched tufts. The cam reciprocates loopers which face in a direction opposite to the direction of movement of the backing material, the looper being reciprocated once for each reciprocation of the needle. Each looper catches and holds the bight of the loop being sewn during the period of maximum penetration by the needle and then moves the bight of that loop beyond the needle so that the needle sews the next loop through the held loop, the looper releasing the held loop and catching the inserted loop, thereafter.

10 Claims, 13 Drawing Figures

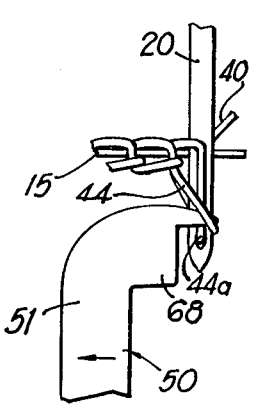
FIG 4
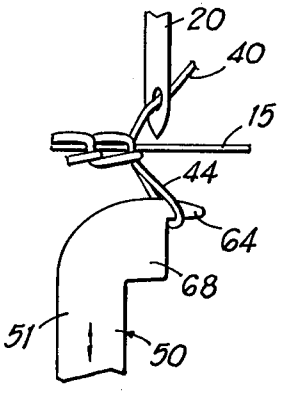
FIG 5
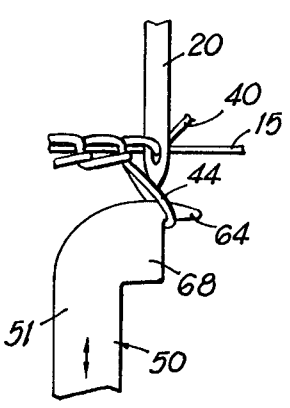
FIG 6
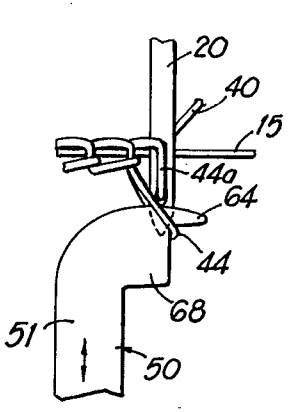
FIG 7
FIG 8
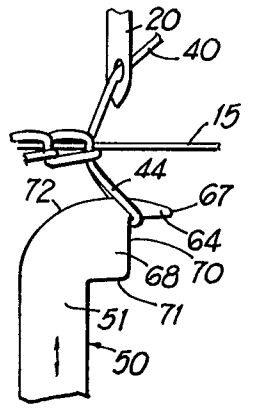
FIG 9
FIG 10
FIG 11
FIG 12
FIG 13

APPARATUS AND PROCESS FOR PRODUCING A CHAIN STITCHED TUFTED PRODUCT

BACKGROUND OF THE INVENTION

1. Field of the Invention

This invention relates to a tufting machine and is more particularly concerned with an apparatus and process for producing a chain stitched tufted product.

2. Description of the Prior Art

In the prior art is our U.S. Pat. No. 4,419,944 which, discloses a structure for forming chain stitches from the loop piles produced. In that device there are special loopers having notches or grooves for catching each loop being formed so that it can be pulled in the direction of movement of the backing and then moved in the opposite direction by the looper whereby a subsequent loop can be passed through the bight of a preceeding loop as the preceeding loop is held by the looper. The looper is reciprocated twice for each cycle of the needle. The present invention requires only a single, quite short stroke of the looper for each stitch being formed and requires no grooves to hold the loop as the looper is retracted.

SUMMARY OF THE INVENTION

Briefly described the present invention includes a conventional tufting machine with a special eccentric cam for imparting a quick short stroke to the looper and a period of dwell, each cycle of the machine. The loopers have narrow bills, carried by supporting plates. This arrangement permits the needles to insert the loop being sewn, through a diagonally disposed preceeding loop, with a single stroke of the needle and a single stroke of the looper.

Accordingly, it is an object of the present invention to provide an apparatus and method for readily and easily producing a chain stitched tufted product with only a single stroke of the loopers for each stroke of the needle.

Another object of the present invention is to provide an apparatus for producing a chained stitched tufted product in which apparatus is inexpensive to manufacture, durable in structure and efficient in operation.

Another object of the present invention is to provide a method of producing a chain stitched tufted product which method will assure a tight uniform tuft which is linked to the adjacent tuft.

Another object of the present invention is to provide a tufting machine capable of producing a chain stitched tufted product with the stroke of the looper being short, and over only a portion of the cycle, thereby reducing vibrations caused by the looper.

Other objects, features and advantages of the present invention will become apparent from the following description when taken in conjunction with the accompanying drawing when in like characters of reference designate corresponding parts throughout the several views.

BRIEF DESCRIPTION OF THE DRAWING

FIGS. 4–13, inclusive, are fragmentary side elevational views, showing successive positions of one needle and looper of the tufting machine of FIG. 1, during the formation of the chain stitched tufts.

DESCRIPTION OF THE PREFERRED EMBODIMENT

Figure 1:
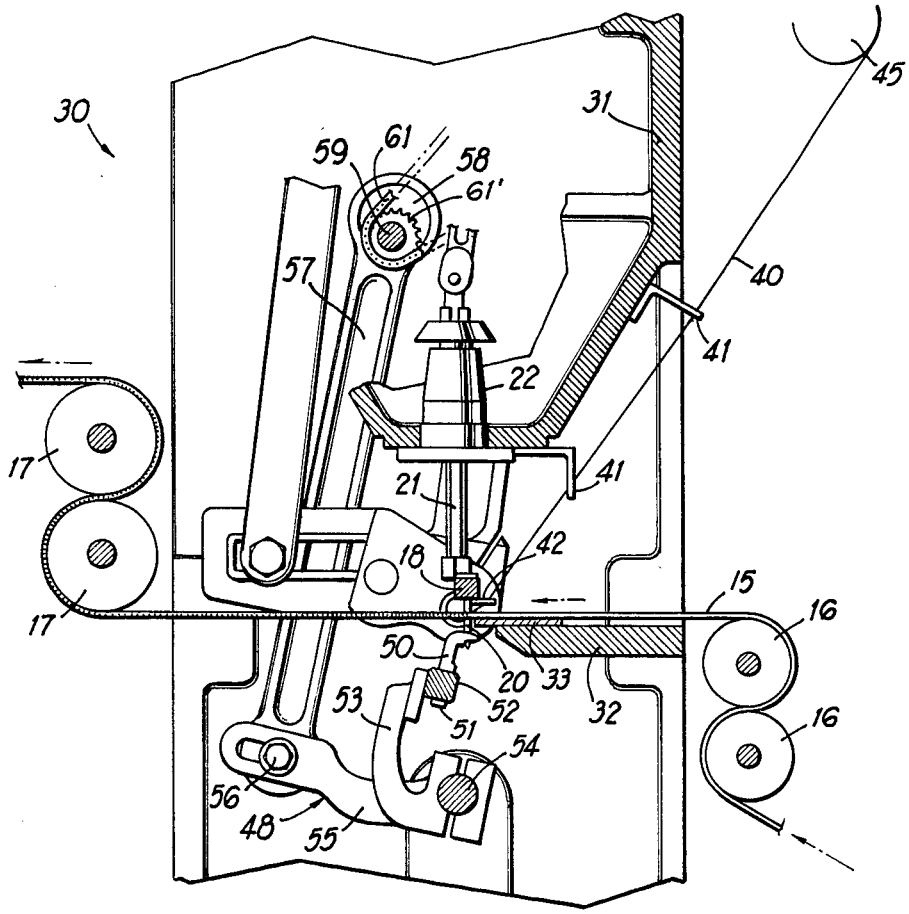
FIG. 1 is a fragmentary vertical section view of a portion of a conventional tufting machine which has been modified so as to produce chain stitched tufted products in accordance with the present invention.
Figure 2:
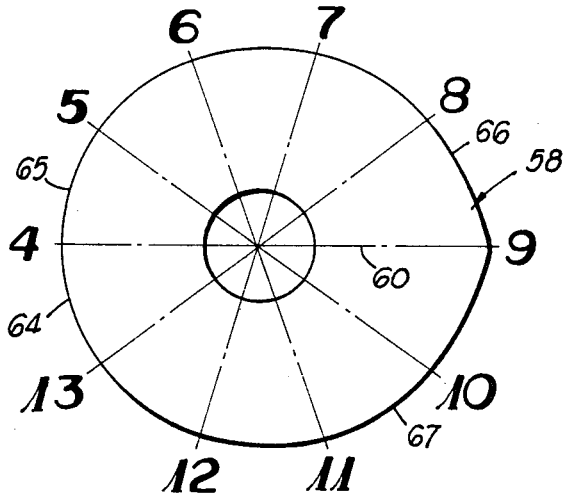
FIG. 2 is an enlarged schematic view of the eccentric or cam utilized by the tufting machine depicted in FIG. 1 for manipulation of the loopers so as to produce the chain stitch, according to the present invention.
Figure 3:
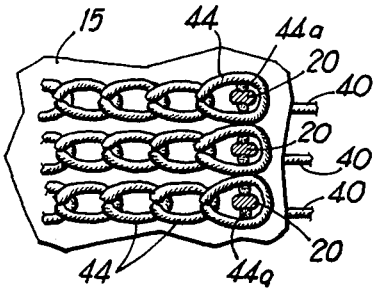
FIG. 3 is a fragmentary bottom plan view of the backing material and showing the chain stitched tufts being produced according to the present invention.

Referring now in detail to the embodiment chosen for the purpose of illustrating the present invention, numeral 30 in FIG. 1 denotes generally the tufting machine, including a frame or housing 31 having a bed plate 32 upon which is supported a needle plate 33. The needle plate 33 is adapted to support, in a substantially horizontal plane, the backing material or base fabric 15 which is adapted to be moved by conventional means, such as fabric feed rollers 16 and 17, along a longitudinal linear path of movement as indicated by the arrow in FIG. 1.

As is conventional, a transversly extending needle bar 18 is disposed above the needle plate 33 and carries a plurality of equally spaced, downward protruding needles 20 which are arranged in one or more transverse rows so that the needles 20 are moved from a retracted position, free of the backing material 15, down through the backing material 15 and then withdrawn from the backing material 15, upon each reciprocation of the needle bar 18. Thus, the needles 20 are inserted each cycle to a uniform extent through the backing material 15.

Needle bar 18 is reciprocated by a plurality of transversly spaced push rods, such as push rod 21, which are slideably carried in sleeve bearings, such as bearing 22, in the housing 31.

As shown in more detail in U.S. Pat. No. 4,419,944, a chain 61, driven in synchronization with the reciprocation of the needle bar 18, drives a sprocket 61' for rotating a hook or looper drive shaft 59. According to the present invention, this hook or looper drive shaft 59 is rotated one revolution upon one reciprocation of the needle bar 18.

Yarn 40 is fed through fixed yarn guides 41 and needle bar yarn guide 42 to each of the needles 20, so that a yarn 40 may be carried by each corresponding needle 20 as it penetrates the backing material 15 to its lowermost position to form a yarn loop 44.

The looper mechanism, denoted generally by the numeral 48 includes a a plurality of loopers, such as looper 50, which respectively cooperate with needles 20. Each looper 50 may, if desired, be in the shape and configuration shown in FIGS. 3–7 of U.S. Pat. No. 4,419,944. Suffice it to state that each looper 50 includes a shank 51 which is mounted in a conventional manner to a hook or looper bar 52 mounted on a rock arm 53 which, in turn, is clamped to a hook or looper shaft 54. The looper shaft 54 is fixed to and driven by a looper drive lever 55, the free end of which is slotted for adjustable pivitable connection by a pin 56 to the lower end of connection rod 57. The upper end of connecting rod 57 is journaled about the rotary eccentric or cam 58 which, in turn, is fixed on the looper drive shaft 59 to form a rotary jack shaft, journaled for rotary movement in the frame 31. A drive sprocket 61 drives through a sprocket (not shown) the looper drive shaft 59 so that the rocking of the looper drive shaft 59 is synchronized with the reciprocation of the needle bar 18. Thus, each looper 50 is rocked back and forth through one reciprocation, upon one reciprocation of the needle 20.

Each looper 50 includes a bill 64 having an upper edge 65 and a lower edge 66 which generally converge forwardly to a point 67. Bill 64 is integrally formed with and protrudes in a longitudinal direction forwardly from the throat plate or bill supporting plate 68, formed as an integral extension of the shank 51. The top edge portion of the looper 50 may be laterally offset from plate 68, or indented, as illustrated in FIG. 9 of U.S. Pat. No. 4,419,944, if desired. The throat plate or supporting plate 68 is mounted on the upper end portion of the shank 51 and protrudes forwardly therefrom, so as to provide a straight generally vertically disposed front edge 70, the upper end portion of which terminates at the edge 66 in a corner 73, forming an obtuse angle with edge 66. The lower portion of the front edge 70 terminates at a lower edge 71 which protrudes rearwardly to merge with the front edge of the shank 51. The upper edge of the throat portion or bill supporting 68 is essentially convex at numeral 72.

All loopers 50 face the forwardly in the machine, that is in a direction opposite to the direction of movement of the backing material 15. This enables the loops 44, 44*a* which are collected on the bill 67 to be pulled inwardly along the bill 54 toward the edge 70 and corner 73.

In operation, the needles 20 sew yarns 40 through the backing material 15 to form transversely spaced rows of successive chain stitched loops 44, 44*a*. In FIGS. 4 through 13 the action of a typical needle 20 and looper 50 is depicted for producing the chain stitch for a single longstiched row of tufts. In FIGS. 4 through 7, looper 50 is in its forwardmost portion and is at dwell. In FIG. 4, it is seen that, when the needle 20 has been reciprocated and is retracted, a first loop 44 is formed in the backing material 15, the bight of the loop 44 being received and then moved slightly forwardly of the needle path by on the bill 64 of the looper 50. This loop 44 forwardly migrates to the corner 73 formed by bottom edge of 66 and front edge 70 as the backing material moves along its longitudenal path of travel and as the bill 64 is carried forwardly to its portion of dwell. After the initial loop 44 has been formed and is retained on the bill 64 of looper 50 and the needle 20 is retracted out of the backing material 15, the needle 20 again begins descending for the formation of a subsequent loop 45*a*. The backing material or base fabric 15 has been moved progressively along its linear path of travel when the needle 20 is retracted and, therefore, the root of loop 44 has been moved in a linear path, from beneath the needle 20. The loop 44 is, therefore, arranged diagonally of the vertical linear path of travel of the needle 20.

In FIG. 5, it is seen that the needle 20 then begins its downward movement so that it again penetrates the backing material 15 but at a position spaced longitudinally from the root of preceeding loop 44. In FIG. 6, it is seen that, as the needle 20 penetrates into the backing material 15, the loop 44 is still held at an angle by the looper 20 since the corner 73 holding the bight is still forwardly of needle 20. Thus, the needle 20 passes through the loop 44 and downwardly along the throat portion or supporting plate 58, inserting the second loop 44*a* through the preceeding loop 44.

The needle 20 continues its travel, as depicted in FIGS. 7, 8 and 9. In FIG. 8, the looper 50 commences its travel rearwardly (in the direction of travel of the backing materials 20) as the second loop 44*a* is being formed. The arrows on looper 50 in FIG. 8 and 9 indicate that the loop 50 is being retracted at these increments in the cycle of the tufting machine. In FIG. 8 it is seen that, since the tip of bill 64 is now rearwardly of the path of travel of needle 20, the needle 20 has inserted loop 44*a* through loop 44 but this loop 44*a* is to one side of bill 64. The bight of loop 44, however, is draped around needle 20. Therefore, as bill 64 is retracted, the shank of needle 20 arrests rearward movement of the bight of loop 44 on the far or front side of needle 20. Hence, a slight retraction of the bill 64, causes the loop 44 to be released from bill 64. Upon such retraction, the loop 44 is arrested by the needle 20 and hence it wiped off of the bill 64.

As shown in FIG. 9, the looper 50 continues its travel rearwardly for only a distance sufficient that the point 67 of the bill 64 clears both loops 44 and 44*a*. Then, as depicted in FIG. 10, the looper 50 begins its movement forwardly back into the loop 44*a*, as the needle 20 is retracted. The looper 50 continues its travel in a forward direction, as illustrated by the arrow in FIG. 11, as the needle 20 clears the looper 50 so as to move the bight of loop 44*a* rearwardly sufficiently for the bight to clear of the needle 20 when it again desends. Upon further retraction of needle 20 as depicted in FIG. 12, the bill 64 remains stationary and retains only the loop 44*a*, which, after retraction of the needle 20 out of the backing material 20 continues to hold the loop 44*a*.

If the feed of the yarn is arrested by the yarn feed mechanism 45, or insufficient yarn is fed to the needle 20 this causes a robbing of the yarn from the preceeding loop 44 so as to tighten that loop around the base of the loop 44*a*. This tightening is facilitated by the movement of the backing material 15 along its linear path of travel. This movement of backing material 15 causes the loop 44*a* to be disposed angularly around the plate or throat 68 of the looper 50, in a position so that the subsequent stroke of the needle 20 will pass a subsequent loop (not shown) through the loop 44*a*.

It is therefore seen that the looper 50 makes only a single short stroke from a retracted position, forwardly during about one-fourth of the cycle, and remains at its forward position for about one half a cycle and then returns to its retracted position in one fourth of the cycle. Upon returning, the looper 50 releases the loop only after a subsequent loop has been formed, and then moves quickly to engage and holds the last formed loop. This smooth linear movement, rearwardly and forwardly, is over a 180° or less travel of cam 58 and the travel is for a relatively short distance. Therefore, the machine of the present invention can run at a relatively high speed, without excessive vibration. The cam 58, operating through connecting rod 57, lever 55, and looper shaft 54, forms a control means for controlling the action of loopers, such as looper 50.

It will be obvious to those skilled in the art that many variations may be made in the embodiment here chosen for the purpose of illustrating the present invention, without departing from the scope thereof as defined by the appended claims.

We claim:

1. A method for producing a chain stitched tufted product in which a backing material is moved along a prescribed first path, disposing a needle with yarn therein on one side of said first path and disposing a looper on the opposite side of said first path, reciprocating said needle in a path of reciprocation for inserting successive increments of said yarn through said backing material to form successive loops as the needle is successively inserted to a prescribed depth of penetration into said backing material, the improvement comprising the steps of:

(a) reciprocating the looper in synchronization with the reciprocation of the needle for moving the bill of the looper past the needle in the first direction of movement opposite the direction of movement of the backing material for inserting said bill through each loop of yarn as the needle approaches its fully inserted position into the backing material and so that the bight of each loop is retained on said bill as the needle is withdrawn from the backing material;

(b) holding the loop of yarn by the bill while the needle is retracted from the backing material and as the root of the loop is moved by the backing material away from the path of reciprocation of the needle;

(c) continuing the movement of said bill in said first direction sufficiently that the engaged bight of the loop is moved beyond the path of travel of said needle and so that such engaged loop is disposed angularly with respect to said path of travel of said needle;

(d) continuing the holding of said bight by said looper as the needle again penetrates the backing material so that a subsequent loop, formed by a subsequent increment of yarn, is inserted by the needle through the held loop; and (e) moving the looper in an opposite direction sufficiently to release the held loop after the needle has inserted the subsequent loop through the held loop.

2. The method defined in claim 1 in which the looper during its reciprocation is held in a stationary forward position holding a loop for approximately one half of each cycle of the needle, is moved rearwardly as the needle is being inserted into the backing material and is moved forwardly again only after the needle has penetrated a substantial distance into the backing material and the preceeding loop has been released by the looper.

3. The method defined in claim 1 in which said looper has a bill with a lower edge and a front edge forming a corner at the intersection so that the loops of yarn are held at the corner.

4. The method defined in claim 1 wherein the feed of the yarn to said needle is arrested sufficiently that the preceding loop is tightened around the loop being formed.

5. Tufting machine for producing a chain stitched tufted product of the type having a frame, means for feeding a backing material progressively across said frame in a longitudenal direction, a needle bar on one side of said backing material, means for reciporcating the needle bar toward and away from the backing material, a plurality of needles carried by said needle bar and projecting toward said backing material, said needles respectively carrying yarns for insertion into said backing material by said needles when said needles are reciprocated, said needles being withdrawn from the backing material during a portion of each cycle of reciprocation of said needle bar, a plurality of loopers disposed on the other side of said backing material, said looper having bills for movement adjacent to said needles, said bills projecting in a direction opposite to the direction in which the backing material is fed, and means for reciprocating said loopers for moving the bills of the loopers along paths of travel adjacent to the needles for respectively inserting the bills into the loops produced by said needles when the needles have been inserted through the backing material, the improvement comprising:

(a) control means for said loopers for synchronizing the movement of said needle bar with the movement of said loopers so that the bills of the loopers are reciprocated through one cycle along their paths of travel each time the needle bar is reciprocated one time, said control means moving the loopers in paths of reciprocation in which the bill of each looper is moved continuously in one direction of reciprocation through only a portion of one cycle for inserting the bill of each looper through the loop carried by its needle, after the needle has penetrated the backing material and such movement is continued in said one direction for disposing the bight of the loop out of the path of reciprocation of its needle for holding this bight so that the subsequent loop sewn by the needle into the backing material passes through the held loop on the bill; then during the penetration of the needle into the backing material moving said looper in the opposite direction of reciprocation for releasing the held loop; and thereafter in a subsequent cycle again moving the looper in the direction of reciprocation for again inserting the bill of the looper through the subsequent loop during the period in which the needle is penetrating the backing material for permitting the bill to move and hold the bight of the subsequent loop out of the path of travel of the needle.

6. The tufting machine defined in claim 5 wherein said control means includes an eccentric cam rotating one revolution for each cycle of the needle bar, a connecting rod one end of which journals said cam, a shaft for carrying said looper and a lever connected between said shaft and the other end of said connecting rod, said shaft rocking said looper upon rotation of said cam.

7. The tufting machine defined in claim 5 in which said cam is circular through approximately one half the circumfrence of the cam to provide for a dwell of the looper during a period in which the needle is retracted and then reinserted through the backing material for permitting the bill to hold the bight of the loop as the backing material moves the root of the loop away from the path of travel of the needle.

8. The tufting machines defined in claim 7 wherein said cam has a progressively larger diameter peripheral portion over the about one fourth of circumference of the cam and a progressively smaller diameter peripheral second portion over a remaining portion of the circumference of the cam.

9. The tufting machine defined in claim 5 in which said control means causes said looper to dwell in its movement between the time the loop is carried beyond the needle and is released.

10. The tufting machine defined in claim 5 wherein said control means includes means for holding the looper in essentially a stationary position during a portion of each cycle for holding the bight of the loop on one side of the path of travel of the needle as the needle is withdrawn and as the backing material moves the root of the loop in the other direction away from the path of travel of the needle and as a subsequent loop is inserted through the backing material.

* * * * *